US007285206B2

(12) United States Patent
Germaine

(10) Patent No.: US 7,285,206 B2
(45) Date of Patent: Oct. 23, 2007

(54) PROCESS TO PREPARE A LUBRICATING BASE OIL AND A GAS OIL

(75) Inventor: Gilbert Robert Bernard Germaine, Petit Couronne (FR)

(73) Assignee: Shell Oil Company, Houston, TX (US)

( * ) Notice: Subject to any disclaimer, the term of this patent is extended or adjusted under 35 U.S.C. 154(b) by 486 days.

(21) Appl. No.: 10/471,053

(22) PCT Filed: Mar. 4, 2002

(86) PCT No.: PCT/EP02/02366

§ 371 (c)(1),
(2), (4) Date: Sep. 4, 2003

(87) PCT Pub. No.: WO02/070629

PCT Pub. Date: Sep. 12, 2002

(65) Prior Publication Data

US 2004/0045868 A1 Mar. 11, 2004

(30) Foreign Application Priority Data

Mar. 5, 2001 (EP) ..... 01400562
Aug. 16, 2001 (EP) ..... 01402181

(51) Int. Cl.
*C10G 69/00* (2006.01)
*C10G 71/00* (2006.01)

(52) U.S. Cl. ..... 208/950; 208/58; 208/18; 208/96

(58) Field of Classification Search ..... 208/58, 208/18, 950, 96
See application file for complete search history.

(56) References Cited

U.S. PATENT DOCUMENTS

| | | | | |
|---|---|---|---|---|
| 2,603,589 | A * | 7/1952 | Schaerer | 208/24 |
| 3,876,522 | A | 4/1975 | Campbell et al. | 208/58 |
| 3,965,018 | A | 6/1976 | Heilman et al. | 252/59 |
| 4,299,714 | A | 11/1981 | Sugiura et al. | 252/73 |
| 4,343,692 | A | 8/1982 | Winquist | |
| 4,574,043 | A | 3/1986 | Chester et al. | |
| 4,582,616 | A | 4/1986 | Kita et al. | 252/17 |
| 4,859,311 | A | 8/1989 | Miller | |

(Continued)

FOREIGN PATENT DOCUMENTS

AU 5785862 7/1998

(Continued)

OTHER PUBLICATIONS

Fisher-Tropsch Waxes (LeRoux, Oranje) Part I.

(Continued)

*Primary Examiner*—Glenn Caldarola
*Assistant Examiner*—John C. Douglas

(57) ABSTRACT

A process to prepare a lubricating base oil and a gas oil by (a) hydrocracking/hydroisomerizing a Fischer-Tropsch product, wherein weight ratio of compounds having at least 60 or more carbon atoms and compounds having at least 30 carbon atoms in the Fischer-Tropsch product is at least 0.2, and, wherein at least 30 wt % of compounds in the Fischer-Tropsch product have at least 30 carbon atoms;
(b) separating the product of step (a) into one or more gas oil fractions, a base oil precursor fraction and a higher boiling fraction; and
(c) performing a pour point reducing step to the base oil precursor fraction obtained in step (b).

19 Claims, 1 Drawing Sheet

U.S. PATENT DOCUMENTS

| | | | | |
|---|---|---|---|---|
| 4,919,788 | A | 4/1990 | Chen et al. | 208/59 |
| 4,943,672 | A | 7/1990 | Hamner et al. | 585/737 |
| 4,983,273 | A | 1/1991 | Kennedy et al. | 208/89 |
| 5,053,373 | A | 10/1991 | Zones | |
| 5,059,299 | A | 10/1991 | Cody et al. | 208/27 |
| 5,135,638 | A | 8/1992 | Miller | 208/27 |
| 5,157,191 | A | 10/1992 | Bowes | |
| 5,252,527 | A | 10/1993 | Zones | |
| 5,362,378 | A * | 11/1994 | Borghard et al. | 208/138 |
| 5,370,818 | A | 12/1994 | Schleifstein | 252/186.25 |
| 5,372,703 | A | 12/1994 | Kamiya et al. | 208/58 |
| 5,447,621 | A * | 9/1995 | Hunter | 208/58 |
| 5,456,820 | A * | 10/1995 | Forbus et al. | 208/111.01 |
| 5,693,598 | A | 12/1997 | Abraham et al. | 508/444 |
| 5,723,716 | A | 3/1998 | Brandes et al. | 585/734 |
| 5,770,542 | A * | 6/1998 | Brandes et al. | 502/67 |
| 5,804,058 | A * | 9/1998 | Grandvallet et al. | 208/111.1 |
| 5,856,365 | A | 1/1999 | Zennaro et al. | 518/715 |
| 5,935,417 | A * | 8/1999 | Cody et al. | 208/87 |
| 6,059,955 | A | 5/2000 | Cody et al. | 208/18 |
| 6,060,437 | A | 5/2000 | Robson et al. | 508/371 |
| 6,090,989 | A | 7/2000 | Trewalla et al. | 585/13 |
| 6,103,099 | A | 8/2000 | Wittenbrink et al. | 208/27 |
| 6,165,949 | A | 12/2000 | Berlowitz et al. | |
| 6,179,994 | B1 | 1/2001 | Clark et al. | |
| 6,627,779 | B2 | 9/2003 | O'Rear | 585/302 |
| 6,642,189 | B2 | 11/2003 | Kurihara et al. | 508/364 |
| 2003/0119682 | A1 | 6/2003 | Saini et al. | 508/167 |
| 2004/0099571 | A1* | 5/2004 | Germaine et al. | 208/108 |
| 2004/0118744 | A1 | 6/2004 | Daniel et al. | 208/18 |
| 2004/0192979 | A1 | 9/2004 | Matthai et al. | 585/16 |

FOREIGN PATENT DOCUMENTS

| | | | |
|---|---|---|---|
| AU | 698392 | | 10/1998 |
| EP | 113579 | A2 | 7/1984 |
| EP | 0237655 | A1 | 9/1987 |
| EP | 323092 | | 7/1989 |
| EP | 426223 | A1 | 5/1991 |
| EP | 0471524 | | 2/1992 |
| EP | 0532118 | | 3/1993 |
| EP | 0668342 | | 8/1995 |
| EP | 0666894 | | 1/1997 |
| EP | 0 776 959 | | 6/1997 |
| EP | 0832171 | | 1/2000 |
| EP | 1102827 | | 9/2002 |
| EP | 1.365.005 | A1 | 11/2003 |
| EP | 1.389.635 | A1 | 2/2004 |
| EP | 1.370.633 | B1 | 8/2005 |
| EP | 1.366.134 | B1 | 11/2005 |
| GB | 713910 | | 8/1954 |
| JP | 401133988 | A | 5/1989 |
| WO | 94/10263 | | 5/1994 |
| WO | WO 95/23765 | | 9/1995 |
| WO | 96/03359 | | 2/1996 |
| WO | 97/18278 | | 5/1997 |
| WO | 97/21788 | | 6/1997 |
| WO | WO98/02503 | | 1/1998 |
| WO | 99/20720 | | 4/1999 |
| WO | 99/34917 | | 7/1999 |
| WO | 00/14179 | | 3/2000 |
| WO | 00/15736 | | 3/2000 |
| WO | WO00/14184 | | 3/2000 |
| WO | WO 00/14187 | | 3/2000 |
| WO | WO 00/14188 | | 3/2000 |
| WO | WO0014183 | | 3/2000 |
| WO | 00/29511 | | 5/2000 |
| WO | WO0107469 | | 2/2001 |
| WO | WO0107538 | | 2/2001 |
| WO | 01/18156 | | 3/2001 |
| WO | WO0157166 | | 8/2001 |
| WO | WO01074969 | | 11/2001 |
| WO | WO02064710 | | 8/2002 |
| WO | WO02064711 | | 8/2002 |
| WO | WO02070627 | | 9/2002 |
| WO | WO02070629 | | 9/2002 |
| WO | WO02070630 | | 9/2002 |
| WO | WO02096842 | | 12/2002 |

OTHER PUBLICATIONS

Sasolwax H1 Ceterificate of Analysis.
Gas Chromatography Analysis of Sasolwax H1.
Letter dated Jun. 14, 2004 from Shell to EPO on EP 02762138.7.
Register extract for EP20020732741.0.
Dissertation of Glenda Webber. Sep. 2000. "Wax Characterisation by Instrumental Analysis", pp. 52-58.
M.M.G. Senden, "The Shell Middle Distillate Synthesis Process: Commerical plant experience and outlook into the future". Petrole et Techniques. Association Francaise Des Technic. Paris, Fr., No. 415. Jul. 1998. XP00)771962. pp. 94-97.
"Shell Middle Distillate Synthesis", Internet article. XP-002214343.
Sie, S. T. et al. "Conversion of Natural Gas to Transportation Fuels Via the Shell Middle Distillate Synthesis Process (SMDS)", Catalysis Today. vol. 8. 1991. pp. 371-394.
Peter J.A. Tijm. Shell Intl Gas Ltd. Alternative Energy 1995, "The Markets for Shell Middle Distillate Synthesis Products", Vancouver, Canada, May 2-4, 1995.
Shell MDS (Malaysia) "Manufacturing Clean Products From Natural Gas", May 1995.
ASTM D86—Standard Test Method for Distillation of Petroleum Products at Atmospheric Pressure.
ASTM D1160—Standard Method for Distillation of Petroleum Products at Reduced Pressure.
ASTM D2887 Standard Test Method for Boiling Range Distribution of Petroleum Fractions by Gas Chromatography.
Extract from the website http://www.schu.ac.uk. providing a description of the gas chromatography technique.
Introduction to Organic Laboratory Techniques, D L Pavia et al. 1976. pp. 614-625.
Letter from the Patentee to the EPO dated Jun. 14, 2004 in European Patent Application No. 02716826.9.
Extract from web-site http://www.deh.gov.au. providing a sumary of the development of the European Union fuel standard through the years 1993 and 2000 (so-called "Euro-2" and "Euro-3" respectively) and beyond. for petrol (gasoline) and diesel fuel.
Lewis. Sr.. Richard J.: Hawley's Condensed Chemical Dictionary. 14th Ed., John Wiley & Sons. New York. 2001 (p. 228).
Ballard. D. H.. Generalizing the Hough Transformation to Detect Arbitrary Shapes. Pattern Recognition. vol. 13. No. 2. pp. 111-122. 1981.
Z. Liang & C. S. Hsu. "Molecular Speciation of Saturates by On-Line Liquid Chromatography-Field Ionization Mass Spectrometry", Energy & Fuel, Apr. 1998.
Affidavit of John Rosenbaum dated Nov. 4, 2004, filed in connection with opposition proceedings on EP-B-1102827.
Opponent Shell submission in opposition proceedings against EP-B-1102827, letter dated Nov. 2, 2004, pp. 2 and 16-22.
1996 exchange of correspondence between Shell Malaysia and Yukong.
1996 sales invoice of waxy raffinate to Bentley Chemplax (Australia).
Bill from Showa Shell to General Sekiyu dated Jun. 12, 1997.
Affidavit of Mr. Masami Sakaguchi dated Jun. 17, 2004.
Internal Showa Shell note dated Oct. 17, 1996 re shipment of Process Oil 123X.
Sample Request Form for waxy raffinate Jul. 1996.
1993 Showa Shell brochure on XHVI.
Shell records relating to retained sample of commerical XHVI 5.2 base oil.
1996 exchange of correspondence between Chevron and Shell Malaysia.

R.M. Mortier & S.T. Orszulik. "Chemistry and Technology of Lubricants", 2nd Ed.. pp. 4-5, 1997.
Affidavit of Susan Abernathy, filed in the Opposition to EP1368446.
Affidavit of Dennis O'Rear.
Lucie Coniglio and Armelle Nouviaire "A Method for Estimating the Normal Boiling Point of Heavy Hydrocarbons Suitable for a Group-Contribution-Based Equation of State", published in 2001 by the American Chemical Society. Incl. Eng. Chem. Res. 2001. 40. 1781-1790.
SAE Surface Vehicle Standard J300, Rev. Dec. 1999, J. Mass Spectrometry. vol. 31. 383-388 (1996), Klesper & Rollgen.
International Search Report dated Jul. 29, 2002.
Lubricant Base Oil and Wax Processing, Avilino Sequeira, Jr., Marcel Dekker Inc., New York 1994, Chapter 7.
Kirk-Othmer Encyclopedia of Chemical Technology, 3rd edition, vol. 14, pp. 477-526, no date.

* cited by examiner

PROCESS TO PREPARE A LUBRICATING BASE OIL AND A GAS OIL

FIELD OF THE INVENTION

The invention is directed to a process to prepare a lubricating base oil and a gas oil from a Fischer-Tropsch product.

BACKGROUND OF THE INVENTION

Such a process is described in EP-A-776959. In the disclosed process a narrow boiling fraction of a Fischer-Tropsch wax is hydrocracked/hydroisomerised and subsequently dewaxed in order to lower the pour point. The Fischer-Tropsch wax typically has an initial boiling point of about 370° C. The examples illustrate that a base oil can be prepared having a viscosity index of 151, a pour point of −27° C., a kinematic viscosity at 100° C. of 5 cSt and a Noack volatility of 8.8%. The yield of base oils in this experiment was 62.4% based on the Fischer-Tropsch wax. The main product of this process is base oils.

In the Fischer-Tropsch reaction a Fischer-Tropsch product is obtained comprising, next to the Fischer-Tropsch wax, a fraction boiling below 370° C. It is furthermore desirable to prepare fuel products, such as gas oils, from the Fischer-Tropsch product next to the base oil products. There is thus a desire to have a simple process, which can yield fuels products and base oils from a Fischer-Tropsch product.

SUMMARY OF THE INVENTION

The following process provides a simple process, which yields gas oils and base oils whilst minimizing the number of process steps. Process to prepare a lubricating base oil and a gas oil by (a) hydrocracking/hydroisomerisating a Fischer-Tropsch product, wherein weight ratio of compounds having at least 60 or more carbon atoms and compounds having at least 30 carbon atoms in the Fischer-Tropsch product is at least 0.2 and wherein at least 30 wt % of compounds in the Fischer-Tropsch product have at least 30 carbon atoms, (b) separating the product of step (a) into one or more gas oil fractions, a base oil precursor fraction and a higher boiling fraction, and (c) performing a pour point reducing step to the base oil precursor fraction obtained in step (b).

BRIEF DESCRIPTION OF THE DRAWINGS

The FIGURE shows a preferred embodiment of the process according to the present invention.

DETAILED DESCRIPTION OF THE INVENTION

Figure 1:
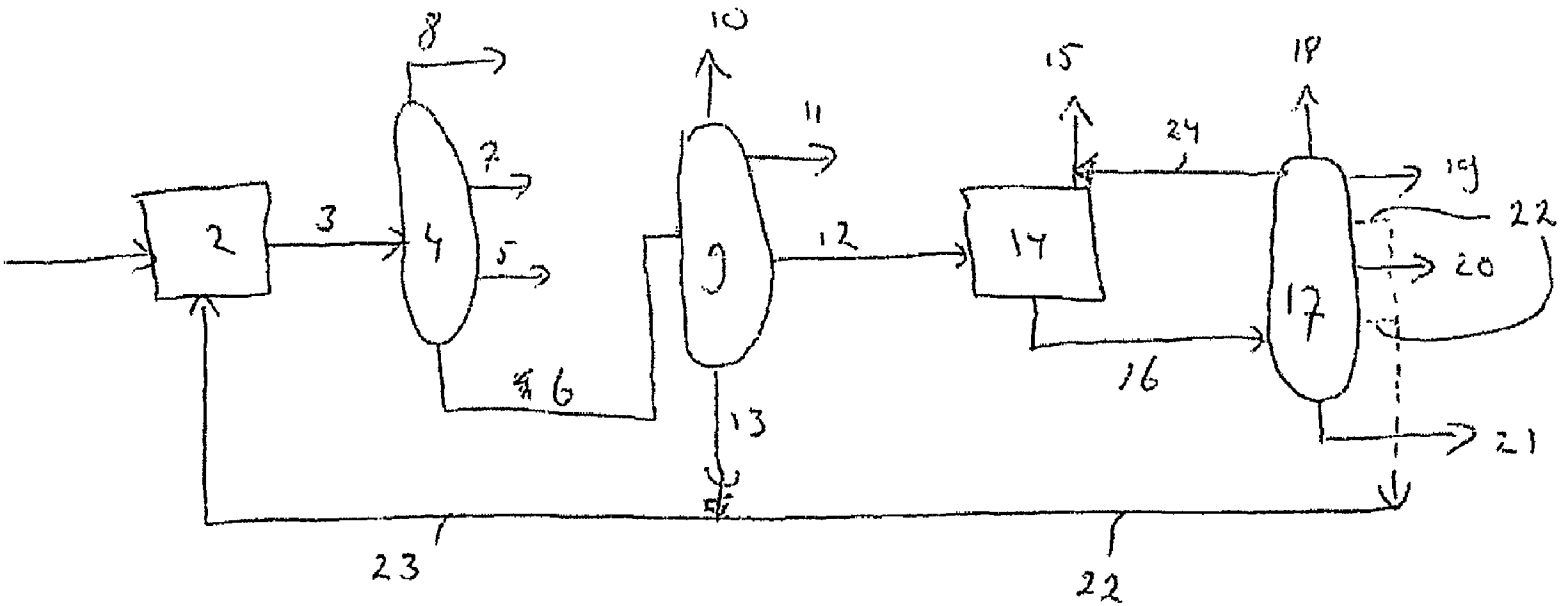

Applicants found that by performing the hydrocracking/hydroisomerization step with the relatively heavy feedstock a higher yield of gas oils as calculated on the feed to step (a) can be obtained. A further advantage is that both fuels, for example gas oil, and material suited for preparing base oils are prepared in one hydrocracking/hydroisomerization process step. This line up is more simple than a line up wherein a dedicated base oil hydrocracking/hydroisomerization step is performed on a Fischer-Tropsch wax boiling mainly above 370° C. as described in for example WOA0014179 hereby incorporated by reference. In a preferred embodiment of the present invention all or part of the higher boiling fraction obtained in step (b) is recycled to step (a).

A further advantage is that base oils are prepared having a relatively high content of cyclo-paraffins, which is favourable to achieve desired solvency properties. The content of cyclo-paraffins in the saturates fraction of the obtained base oil have been found to be between 5 and 40 wt %. Base oils having a cyclo-paraffin content in the saturates fraction of between 12 and 20 wt % have been furthermore found to be excellent base stocks to formulate motor engine lubricants.

The process of the present invention also results in middle distillates having exceptionally good cold flow properties. These excellent cold flow properties could perhaps be explained by the relatively high ratio iso/normal and especially the relatively high amount of di- and/or trimethyl compounds. Nevertheless, the cetane number of the diesel fraction is more than excellent at values far exceeding 60, often values of 70 or more are obtained. In addition, the sulphur content is extremely low, always less than 50 ppmw, usually less than 5 ppmw and in most case the sulphur-content is zero. Further, the density of especially the diesel fraction is less than 800 kg/m$^3$, in most cases a density is observed between 765 and 790 kg/m$^3$, usually around 780 kg/m$^3$ (the viscosity at 100° C. for such a sample being about 3.0 cSt). Aromatic compounds are virtually absent, i.e. less than 50 ppmw, resulting in very low particulate emissions. The polyaromatic content is even much lower than the aromatic content, usually less than 1 ppmw. T95, in combination with the above properties, is below 380° C., often below 350° C.

The process as described above results in middle distillates having extremely good cold flow properties. For instance, the cloud point of any diesel fraction is usually below −18° C., often even lower than −24° C. The CFPP is usually below −20° C., often −28° C. or lower. The pour point is usually below −18° C., often below −24° C.

The relatively heavy Fischer-Tropsch product used in step (a) has at least 30 wt %, preferably at least 50 wt %, and more preferably at least 55 wt % of compounds having at least 30 carbon atoms. Furthermore the weight ratio of compounds having at least 60 or more carbon atoms and compounds having at least 30 carbon atoms of the Fischer-Tropsch product is at least 0.2, preferably at least 0.4 and more preferably at least 0.55. Preferably the Fischer-Tropsch product comprises a $C_{20}^{+}$ fraction having an ASF-alpha value (Anderson-Schulz-Flory chain growth factor) of at least 0.925, preferably at least 0.935, more preferably at least 0.945, even more preferably at least 0.955.

The initial boiling point of the Fischer-Tropsch product may range up to 400° C., but is preferably below 200° C. Preferably any compounds having 4 or less carbon atoms and any compounds having a boiling point in that range are separated from a Fischer-Tropsch synthesis product before the Fischer-Tropsch synthesis product is used in step (a). The Fischer-Tropsch product as described in detail above is a Fischer-Tropsch product, which has not been subjected to a hydroconversion step as defined according to the present invention. The content of non-branched compounds in the Fischer-Tropsch product will therefore be above 80 wt %. In addition to the Fischer-Tropsch product also other fractions may be additionally processed in step (a). Possible other fractions may suitably be the higher boiling fraction obtained in step (b) or part of said fraction and/or off-spec base oil fractions as obtained in step (c).

Such a Fischer-Tropsch product can be obtained by any process, which yields a relatively heavy Fischer-Tropsch product. Not all Fischer-Tropsch processes yield such a heavy product. An example of a suitable Fischer-Tropsch process is described in WO-A-9934917 and in AU-A-698392 both are hereby incorporated by reference. These processes may yield a Fischer-Tropsch product as described above.

The Fischer-Tropsch product will contain no or very little sulphur and nitrogen containing compounds. This is typical for a product derived from a Fischer-Tropsch reaction, which uses synthesis gas containing almost no impurities. Sulphur and nitrogen levels will generally be below the detection limits, which are currently 5 ppm for sulphur and 1 ppm for nitrogen.

The Fischer-Tropsch product may optionally be subjected to a mild hydrotreatment step in order to remove any oxygenates and saturate any olefinic compounds present in the reaction product of the Fischer-Tropsch reaction. Such a hydrotreatment is described in EP-B66834 hereby incorporated by reference. The mildness of the hydrotreating step is preferably expressed in that the degree of conversion in this step is less than 20 wt % and more preferably less than 10 wt %. The conversion is here defined as the weight percentage of the feed boiling above 370° C., which reacts to a fraction boiling below 370° C. After such a mild hydrotreatment lower boiling compounds, having four or less carbon atoms and other compounds boiling in that range, will preferably be removed from the effluent before it is used in step (a).

The hydrocracking/hydroisomerization reaction of step (a) is preferably performed in the presence of hydrogen and a catalyst, which catalyst can be chosen from those known to one skilled in the art as being suitable for this reaction. Catalysts for use in step (a) typically comprise an acidic functionality and a hydrogenation/dehydrogenation functionality. Preferred acidic functionality's are refractory metal oxide carriers. Suitable carrier materials include silica, alumina, silica-alumina, zirconia, titania and mixtures thereof. Preferred carrier materials for inclusion in the catalyst for use in the process of this invention are silica, alumina and silica-alumina. A particularly preferred catalyst comprises platinum supported on a silica-alumina carrier. If desired, applying a halogen moiety, in particular fluorine, or a phosphorous moiety to the carrier, may enhance the acidity of the catalyst carrier. Examples of suitable hydrocracking/hydroisomerization processes and suitable catalysts are described in WO-A-0014179, EP-A-5321 18, EP-A-666894 and the earlier referred to EP-A-776959 all are hereby incorporated by reference.

Preferred hydrogenation/dehydrogenation functionality's are Group VIII noble metals, for example palladium and more preferably platinum. The catalyst may comprise the hydrogenation/dehydrogenation active component in an amount of from 0.005 to 5 parts by weight, preferably from 0.02 to 2 parts by weight, per 100 parts by weight of carrier material. A particularly preferred catalyst for use in the hydroconversion stage comprises platinum in an amount in the range of from 0.05 to 2 parts by weight, more preferably from 0.1 to 1 parts by weight, per 100 parts by weight of carrier material. The catalyst may also comprise a binder to enhance the strength of the catalyst. The binder can be non-acidic. Examples are clays and other binders known to one skilled in the art.

In step (a) the feed is contacted with hydrogen in the presence of the catalyst at elevated temperature and pressure. The temperatures typically will be in the range of from 175 to 380° C., preferably higher than 250° C. and more preferably from 300 to 370° C. The pressure will typically be in the range of from 10 to 250 bar and preferably between 20 and 80 bar. Hydrogen may be supplied at a gas hourly space velocity of from 100 to 10000 Nl/l/hr, preferably from 500 to 5000 Nl/l/hr. The hydrocarbon feed may be provided at a weight hourly space velocity of from 0.1 to 5 kg/l/hr, preferably higher than 0.5 kg/l/hr and more preferably lower than 2 kg/l/hr. The ratio of hydrogen to hydrocarbon feed may range from 100 to 5000 Nl/kg and is preferably from 250 to 2500 Nl/kg.

The conversion in step (a) as defined as the weight percentage of the feed boiling above 370° C. which reacts per pass to a fraction boiling below 370° C., is at least 20 wt %, preferably at least 25 wt %, but preferably not more than 80 wt %, more preferably not more than 70 wt %. The feed as used above in the definition is the total hydrocarbon feed fed to step (a), thus also any optional recycle of the higher boiling fraction as obtained in step (b).

In step (b) the product of step (a) is separated into one or more gas oil fractions, a base oil precursor fraction having preferably a T10 wt % boiling point of between 200 and 450° C. and a T90 wt % boiling point of between 300, and preferably between 400 and 550° C. and a higher boiling fraction. By performing step (c) on the preferred narrow boiling base oil precursor fraction obtained in step (b) a haze free base oil grade can be obtained having also excellent other quality properties. The separation is preferably performed by means of a first distillation at about atmospheric conditions, preferably at a pressure of between 1.2-2 bara, wherein the gas oil product and lower boiling fractions, such as naphtha and kerosine fractions, are separated from the higher boiling fraction of the product of step (a). The higher boiling fraction, of which suitably at least 95 wt % boils above 370° C., is subsequently further separated in a vacuum distillation step wherein a vacuum gas oil fraction, the base oil precursor fraction and the higher boiling fraction are obtained. The vacuum distillation is suitably performed at a pressure of between 0.001 and 0.05 bara.

The base oil precursor fraction may in addition or alternatively be a fraction boiling in the gas oil range as obtained in the atmospheric distillation step. It has been found that from such a fraction a base oil having a kinematic viscosity at 100° C. of between about 2 and about 3 cSt can be obtained, especially when the pour point reducing step (c) is performed by a catalytic dewaxing process as described below in more detail.

The vacuum distillation of step (b) is preferably operated such that the desired base oil precursor fraction is obtained boiling in the specified range and having a kinematic viscosity, which relates to the base oil end product(s) specification. The kinematic viscosity at 100° C. of the base oil precursor fraction is preferably between 3 and 10 cSt.

In a first embodiment of the present invention one base oil grade is prepared at a time from the base oil precursor fraction. If, for example, in this embodiment two or more base oil grades are to be prepared having different kinematic viscosities at 100° C. step (b) is suitably performed as follows. The separate base oil grades are prepared in a blocked out mode from base oil precursor fractions which properties correspond with the desired base oil grades. The base oil precursor fraction is prepared one after the other in a period of time in the vacuum distillation. It has been found that by performing the vacuum distillation sequentially for each desired base oil grade high yields of the separate base oils can be obtained. This is especially the case when the difference in kinematic viscosity at 100° C. between the various grades is small, i.e. smaller than 2 cSt. In this manner a base oil grade having a kinematic viscosity at 100°

C. of between 3.5 and 4.5 cSt and a second base oil grade having a kinematic viscosity at 100° C. of between 4.5 and 5.5 cSt can be advantageously prepared in high yields by performing the vacuum distillation in a first mode (v1) to obtain a base oil precursor fraction having a kinematic viscosity at 100° C. corresponding to the first base oil grade and in a second mode (v2) to obtain a base oil precursor fraction having a kinematic viscosity at 100° C. corresponding to the second base oil grade. By performing the pour point reducing step (c) separately on the first and second base oil precursor fractions high quality base oils can be obtained.

After performing a catalytic dewaxing step (c) or after the optional hydrogenation step (d) (see below) lower boiling compounds formed during catalytic dewaxing are removed, preferably by means of distillation, optionally in combination with an initial flashing step. By choosing a suitable distillation cut in the alternating vacuum distillation mode (v) of step (b) it is possible to obtain the separate base oil directly after a catalytic dewaxing step (c) or optional step (d) without having to remove any higher boiling compounds from the end base oil grade. In a preferred embodiment a first base oil (grade-4) is prepared having a kinematic viscosity at 100° C. of between 3.5 and 4.5 cSt (according to ASTM D 445), a Noack volatility of below 20 wt %, preferably below 14 wt % (according to CEC L40 T87) and a pour point of between −15 and −60° C., preferably between −25 and −60° C., (according to ASTM D 97) by catalytic dewaxing in step (b) a distillate fraction obtained in step (a) having a kinematic viscosity at 100° C. of between 3.2 and 4.4 cSt and a second base oil (grade-S) is prepared having a kinematic viscosity at 100° C. of between 4.5 and 5.5, a Noack volatility of lower than 14 wt % preferably lower than 10 wt % and a pour point of between −15 and −60° C., preferably between −25 and −60° C., by catalytic dewaxing in step (b) a distillate fraction obtained in step (a) having a kinematic viscosity at 100° C. (vK@100) of between 4.2 and 5.4 cSt.

In a second embodiment of the present invention more than one viscosity grade base oil is prepared at a time starting from a base oil precursor fraction. In this mode the effluent of step (c) or the optional step (d) is separated into various distillate fractions comprising two or more base oil grades. In order to meet the desired viscosity grades and volatility requirements of the various base oil grades preferably off-spec fractions boiling between, above and/or below the desired base oil grades are also obtained as separate fractions. These fractions having an initial boiling point of above 340° C. may advantageously be recycled to step (a). Any fractions obtained boiling in the gas oil range or below may suitably be recycled to step (b) or alternatively be used as a blending component to prepare a gas oil fuel composition. The separation into the various fractions may suitably be performed in a vacuum distillation column provided with side stripers to separate the fraction from said column. In this mode it is found possible to obtain for example a base oil having a viscosity between 2-3 cSt, a base oil having a viscosity between 4-6 cSt and a base oil having a viscosity between 7-10 cSt product simultaneously from a single base oil precursor fraction (viscosities as kinematic viscosity at 100° C.). A grade-4 and/or grade-5 base oil having the properties as described above may advantageously be obtained as the 4-6 cSt base oil product.

In step (c) the base oil precursor fraction obtained in step (b) is subjected to a pour point reducing treatment. With a pour point reducing treatment is understood every process wherein the pour point of the base oil is reduced by more than 10° C., preferably more than 20° C., more preferably more than 25° C.

The pour point reducing treatment can be performed by means of a so-called solvent dewaxing process or by means of a catalytic dewaxing process. Solvent dewaxing is well known to those skilled in the art and involves admixture of one or more solvents and/or wax precipitating agents with the base oil precursor fraction and cooling the mixture to a temperature in the range of from −10° C. to −40° C., preferably in the range of from −20° C. to −35° C., to separate the wax from the oil. The oil containing the wax is usually filtered through a filter cloth which can be made of textile fibres, such as cotton; porous metal cloth; or cloth made of synthetic materials. Examples of solvents which may be employed in the solvent dewaxing process are $C_3$-$C_6$ ketones (e.g. methyl ethyl ketone, methyl isobutyl ketone and mixtures thereof), $C_6$-$C_{10}$ aromatic hydrocarbons (e.g. toluene), mixtures of ketones and aromatics (e.g. methyl ethyl ketone and toluene), autorefrigerative solvents such as liquefied, normally gaseous $C_2$-$C_4$ hydrocarbons such as propane, propylene, butane, butylene and mixtures thereof. Mixtures of methyl ethyl ketone and toluene or methyl ethyl ketone and methyl isobutyl ketone are generally preferred. Examples of these and other suitable solvent dewaxing processes are described in Lubricant Base Oil and Wax Processing, Avilino Sequeira, Jr, Marcel Dekker Inc., New York, 1994, Chapter 7.

Preferably step (c) is performed by means of a catalytic dewaxing process. With such a process it has been found that base oils having a pour point of even below −40° C. can be prepared when starting from a base oil precursor fraction as obtained in step (b) of the present process.

The catalytic dewaxing process can be performed by any process wherein in the presence of a catalyst and hydrogen the pour point of the base oil precursor fraction is reduced as specified above. Suitable dewaxing catalysts are heterogeneous catalysts comprising a molecular sieve and optionally in combination with a metal having a hydrogenation function, such as the Group VIII metals. Molecular sieves, and more suitably intermediate pore size zeolites, have shown a good catalytic ability to reduce the pour point of the base oil precursor fraction under catalytic dewaxing conditions. Preferably the intermediate pore size zeolites have a pore diameter of between 0.35 and 0.8 nm. Suitable intermediate pore size zeolites are mordenite, ZSM-5, ZSM-12, ZSM-22, ZSM-23, SSZ-32, ZSM-35 and ZSM-48. Another preferred group of molecular sieves are the silica-alumina-phosphate (SAPO) materials of which SAPO-11 is most preferred as for example described in U.S. Pat No. 4,859,311 hereby incorporated by reference. ZSM-5 may optionally be used in its HZSM-5 form in the absence of any Group VIII metal. The other molecular sieves are preferably used in combination with an added Group VIII metal. Suitable Group VIII metals are nickel, cobalt, platinum and palladium. Examples of possible combinations are Pt/ZSM-35, NiIZSM-5, PtIZSM-23, PdIZSM-23, PtIZSM-48 and Pt/SAPO11. Further details and examples of suitable molecular sieves and dewaxing conditions are for example described in WO-A-9718278, U.S. Pat No. 4,343,692, U.S. Pat No. 5,053,373, U.S. Pat. No. 5,252,527 and U.S. Pat. No. 4,574,043 all of which are hereby incorporated by reference.

The dewaxing catalyst suitably also comprises a binder. The binder can be a synthetic or naturally occurring (inorganic) substance, for example clay, silica and/or metal oxides. Natural occurring clays are for example of the montmorillonite and kaolin families. The binder is preferably a porous binder material, for example a refractory oxide of which examples are: alumina, silica-alumina, silica-magnesia, silica-zirconia, silica-thoria, silica-beryllia, silica-titania as well as ternary compositions for example silica-alumina-thoria, silica-alumina-zirconia, silica-alumina-magnesia and silica-magnesia-zirconia. More preferably a low acidity refractory oxide binder material, which is essentially free of alumina, is used. Examples of these binder materials are silica, zirconia, titanium dioxide, germanium dioxide, boria and mixtures of two or more of these of which examples are listed above. The most preferred binder is silica.

A preferred class of dewaxing catalysts comprise intermediate zeolite crystallites as described above and a low acidity refractory oxide binder material which is essentially free of alumina as described above, wherein the surface of the aluminosilicate zeolite crystallites has been modified by subjecting the aluminosilicate zeolite crystallites to a surface dealumination treatment. A preferred dealumination treatment is by contacting an extrudate of the binder and the zeolite with an aqueous solution of a fluorosilicate salt as described in for example U.S. Pat. No. 5,157,191 or WO-A-0029511 both of which are hereby incorporated by reference. Examples of suitable dewaxing catalysts as described above are silica bound and dealuminated Pt/ZSM-5, silica bound and dealuminated PtIZSM-23, silica bound and dealuminated PtIZSM-12, silica bound and dealuminated PtIZSM-22, as for example described in WO-A-0029511 and EP-B-832171 both of which are hereby incorporated by reference.

Catalytic dewaxing conditions are known in the art and typically involve operating temperatures in the range of from 200 to 500° C., suitably from 250 to 400° C., hydrogen pressures in the range of from 10 to 200 bar, preferably from 40 to 70 bar, weight hourly space velocities (WHSV) in the range of from 0.1 to 10 kg of oil per litre of catalyst per hour (kg/l/hr), suitably from 0.2 to 5 kg/l/hr, more suitably from 0.5 to 3 kg/l/hr and hydrogen to oil ratios in the range of from 100 to 2,000 litres of hydrogen per litre of oil. By varying the temperature between 275, suitably between 315 and 375° C. at between 40-70 bars, in the catalytic dewaxing step it is possible to prepare base oils having different pour point specifications varying from suitably −10 to −60° C.

The effluent of step (c) is optionally subjected to an additional hydrogenation step (d), also referred to as a hydrofinishing step for example if the effluent contains olefins or when the product is sensitive to oxygenation. This step is suitably carried out at a temperature between 180 and 380° C., a total pressure of between 10 to 250 bar and preferably above 100 bar and more preferably between 120 and 250 bar. The WHSV (Weight hourly space velocity) ranges from 0.3 to 2 kg of oil per litre of catalyst per hour (kg/l.h).

The hydrogenation catalyst is suitably a supported catalyst comprising a dispersed Group VIII metal. Possible Group VIII metals are cobalt, nickel, palladium and platinum. Cobalt and nickel containing catalysts may also comprise a Group VIB metal, suitably molybdenum and tungsten. Suitable carrier or support materials are low acidity amorphous refractory oxides. Examples of suitable amorphous refractory oxides include inorganic oxides, such as alumina, silica, titania, zirconia, boria, silica-alumina, fluorided alumina, fluorided silica-alumina and mixtures of two or more of these.

Examples of suitable hydrogenation catalysts are nickel-molybdenum containing catalyst such as KF-847 and KF-8010 (AKZO Nobel) M-8-24 and M-8-25 (BASF), and C-424, DN-l90, HDS-3 and HDS-4 (Criterion); nickel-tungsten containing catalysts such as NI-4342 and NI-4352 (Engelhard) and C-454 (Criterion); cobalt-molybdenum containing catalysts such as KF-330 (AKZO-Nobel), HDS-22 (Criterion) and HPC-601 (Engelhard). Preferably platinum containing and more preferably platinum and palladium containing catalysts are used. Preferred supports for these palladium and/or platinum containing catalysts are amorphous silica-alumina Examples of suitable silica-alumina carriers are disclosed in WO-A-941 0263 hereby incorporated by reference. A preferred catalyst comprises an alloy of palladium and platinum preferably supported on an amorphous silica-alumina carrier of which the commercially available catalyst C-624 of Criterion Catalyst Company (Houston, TX) is an example.

FIG. 1 shows a preferred embodiment of the process according to the present invention. To a hydrocracker reactor (2) a Fischer-Tropsch product (1) is fed. After separation of gaseous products the effluent (3) is separated into a naphtha fraction (8), a kerosene fraction (7), a gas oil fraction (5) and a residue (6). Residue (6) is subsequently further separated in a vacuum distillation column (9) into tops (10), a vacuum gas oil fraction (11), a base oil precursor fraction (12) and a higher boiling fraction (13). The higher boiling fraction (13) is recycled via (23) to reactor (2). The base oil precursor fraction is used a feed to a catalytic dewaxing reactor (14), usually a packed bed reactor.

An intermediate product (16) is obtained by separating the gaseous fraction and part of the gas oil fraction and those compounds boiling within that range (15), which are formed during the catalytic dewaxing process, from the effluent of reactor (14). Intermediate product (16) is fed to a vacuum distillation column (17), which column (17) is provided with means, e.g. side strippers, to discharge along the length of the tower different fractions boiling between the top and bottom distillation products. In FIG. 1 tops (18), a gas oil fraction (24), a light base oil grade (19), an intermediate base oil grade (20) and a heavy base oil grade (21) are obtained as distillate products of column (17). In order to meet volatility requirements of grades (20) and (21) intermediate fractions (22) are withdrawn from the column and recycled via (23) to hydrocracker (2). Gas oil fractions obtained as (24) and (15) may be recycled to distillation column (4) (not shown). Alternatively it may also be possible that the bottom distillate product of column (17) cannot be used as a base oil grade. In such a situation the bottom distillate product is suitably recycled to reactor (2) (not shown).

The above-described Base oil grade-4 can suitably find use as base oil for an Automatic Transmission Fluids (ATF). If the desired vK@100 of the ATF is between 3 and 3.5 cSt, the Base Oil grade-4 is suitably blended with a grade having a vK@100 of about 2 cSt. The base oil having a kinematic viscosity at 100° C. of about 2 to 3 cSt can suitably be obtained by catalytic dewaxing of a suitable gas oil fraction as obtained in the atmospheric and/or vacuum distillation in step (b) as described above. The Automatic Transmission Fluid will comprise the base oil as described above, preferably having a vK@100 of between 3 and 6 cSt, and one or more performance additives. Examples of such performance additives are an antiwear agent, an antioxidant, an ashless dispersant, a pour point depressant, and antifoam agent, a friction modifier, a corrosion inhibitor and a viscosity modifier.

The base oils obtained by the present process having intermediate vK@100 values of between 2 and 9 cSt, of which preferred grades have been described above, are preferably used as base oil in formulations such as automotive (gasoline or diesel) engine oils, electrical oils or transformer oils and refrigerator oils. The use in electrical and refrigerator oils is advantageous because of the naturally low pour point when such a base oil, especially the grades having a pour point of below −40° C., is used to blend such a formulation. This is advantageous because the highly isoparaffinic base oil has a naturally high resistance to oxidation compared to low pour point naphthenic type base oils. Especially the base oils having the very low pour points, suitably lower than −40° C., have been found to be very suitable for use in lubricant formulations such as automotive engine oils of the OW-xx specification according to the SAE J-300 viscosity classification, wherein xx is 20, 30, 40, 50 or 60. It has been found that these high tier lubricant formulations can be prepared with the base oils obtainable by the process of the current invention. Other possible engine oil applications are the 5W-xx and the 10W-xx formulations, wherein the xx is as above. The engine oil formulation will suitably comprise the above described base oil and one or more of additives. Examples of additive types which may form part of the composition are ashless dispersants, detergents, preferably of the over-based type, viscosity modifying polymers, extreme pressure/antiwear additives, preferably of the zinc dialkyl dithiophosphate type (ZDTP), antioxidants, preferably of the hindered phenolic or aminic type, pour point depressants, emulsifiers, demulsifiers, corrosion inhibitors, rust inhibitors, antistaining additives and/or friction modifiers. Specific examples of such additives are described in for example Kirk-Othmer Encyclopedia of Chemical Technology, third edition, volume 14, pages 477-526.

The invention will be illustrated with the following non-limiting examples.

EXAMPLE 1

The $C_5$-$C_{750}$° C.$^+$ fraction of the Fischer-Tropsch product, as obtained in Example VII using the catalyst of Example III of WO-A-9934917 was continuously fed to a hydrocracking step (step (a)). The feed contained about 60 wt % $C_{30}^+$ product. The ratio $C_{60}^+/C_{30}^+$ was about 0.55. In the hydrocracking step the fraction was contacted with a hydrocracking catalyst of Example 1 of EP-A-532118.

The effluent of step (a) was continuously distilled to give lights, fuels and a residue "R" boiling from 370° C. and above. The yield of gas oil fraction on fresh feed to hydrocracking step was 43 wt %. The main part of the residue "R" was recycled to step (a) and a remaining part was separated by means of a vacuum distillation into a base oil precursor fraction having the properties as in Table 1 and a fraction boiling above 510° C.

The conditions in the hydrocracking step (a) were: a fresh feed Weight Hourly Space Velocity (WHSV) of 0.8 kg/l.h, recycle feed WHSV of 0.2 kg/l.h, hydrogen gas rate=1000 Nl/kg, total pressure=40 bar, and a reactor temperature of 335° C.

TABLE 1

| | |
|---|---|
| Density at 70° C. (kg/m$^3$) | 779.2 |
| vK @ 100 (cSt) | 3.818 |
| pour point (° C.) | +18 |
| Boiling point data as temperature at which a wt % is recovered. | 5% 355° C.<br>10% 370° C.<br>50% 419° C.<br>90% 492° C.<br>95% 504° C. |

In the dewaxing step, the fraction of Table 1 was contacted with a dealuminated silica bound ZSM-5 catalyst comprising 0.7% by weight Pt and 30 wt % ZSM-5 as described in Example 9 of WO-A-0029511. The dewaxing conditions were 40 bar hydrogen, WHSV=1 kg/l.h and a temperature of 340° C.

The dewaxed oil was distilled into three base oil fractions: boiling between 378 and 424° C. (yield based on feed to dewaxing step was 14.2 wt %), between 418-455° C. (yield based on feed to dewaxing step was 16.3 wt %) and a fraction boiling above 455° C. (yield based on feed to dewaxing step was 21.6 wt %). See Table 2 for more details.

TABLE 2

| | Light Grade | Medium Grade | Heavy Grade |
|---|---|---|---|
| density at 20° C. | 805.8 | 814.6 | 822.4 |
| pour point (° C.) | <−63 | <−51 | −45 |
| kinematic viscosity at 40° C. (cSt) | | 19.06 | 35.0 |
| kinematic viscosity at 100° C. (cSt) | 3.16 | 4.144 | 6.347 |
| VI | n.a. | 121 | 134 |
| Noack volatility (wt %) | n.a. | 10.8 | 2.24 |
| sulphur content (ppm) | <1 ppm | <1 ppm | <5 ppm |
| saturates (% w) | n.a. | 99.9 | n.a. |
| Content of cyclo-paraffins (wt %) (*) | n.a. | 18.5 | n.a. |
| Dynamic viscosity as measured by CCS at −40° C. | n.a. | 3900 cP | n.a. |

(*) as determined by means of a Finnigan MAT90 mass spectrometer equipped with a Field desorption/field ionisation interface on the saturates fraction of said base oil.
n.a.: not applicable
n.d.: not determined

EXAMPLE 2

Example 1 was repeated except that the dewaxed oil was distilled into the different three base oil products of which the properties are presented in Table 3.

TABLE 3

| | Light Grade | Medium Grade | Heavy Grade |
|---|---|---|---|
| density at 20° C. | 809.1 | 817.2 | 825.1 |
| pour point (° C.) | <−63 | <−51 | −39 |
| kinematic viscosity at 40° C. (cSt) | | 23.32 | 43.01 |
| kinematic viscosity at 100° C. (cSt) | 3.181 | 4.778 | 7.349 |
| VI | n.a. | 128 | 135 |
| Noack volatility (wt %) | n.a. | 7.7 | n.a. |
| sulphur content (ppm) | <5 ppm | <5 ppm | <5 ppm |
| saturates (% w) | | 99.0 | |
| Dynamic viscosity as measured by CCS at −40° C. | | 5500 cP | |
| Yield based on feed to cat dewaxing step (wt %) | 15.3 | 27.4 | 8.9 |

EXAMPLE 3

Example 1 was repeated except that the that the dewaxed oil was distilled into the different three base oil products and one intermediate raffinate (I.R.) of which the properties are presented in Table 4.

TABLE 4

| | Light Grade | I.R. | Medium Grade | Heavy Grade |
|---|---|---|---|---|
| density at 20° C. | 806 | 811.3 | 817.5 | 824.5 |
| pour point (° C.) | <−63 | −57 | <−51 | −39 |
| Kinematic viscosity at 40° C. (cSt) | 10.4 | | 23.51 | 42.23 |
| Kinematic viscosity at 100° C. (cSt) | 2.746 | 3.501 | 4.79 | 7.24 |
| VI | 103 | | 127 | 135 |
| Noack volatility | n.a. | | 6.8 | 1.14 |
| sulphur content (ppm) | <5 ppm | | <5 ppm | <5 ppm |
| Saturates (% w) | n.d. | | 99.5 | |
| Dynamic viscosity as measured by CCS at −40° C. | | | 5500 cP | |
| Yield based on CDW feed | 22.6 | 8.9 | 22.6 | 11.1 |

n.a.: not applicable
n.d.: not determined

EXAMPLE 4

74.6 weight parts of a base oil, having the properties as listed in Table 5 and which was obtained by catalytic dewaxing of a hydroisomerized/hydrocracked Fischer-Tropsch product using the same feed and procedure as illustrated by Examples 1-3, was blended with 14.6 weight parts of a standard detergent inhibitor additive package, 0.25 weight parts of a corrosion inhibitor and 10.56 weight parts of a viscosity modifier. The properties of the resulting composition are listed in Table 6. Table 6 also shows the OW-30 specifications for motor gasoline lubricants. It is clear that the composition as obtained in this Example meets the requirements of an 0W30 motor gasoline specification.

COMPARATIVE EXPERIMENT A 54.65 weight parts of a poly-alpha olefin-4 (PAO-4) and 19.94 weight parts of a poly-alpha olefin-5 (PAO-5), having the properties as listed in Table 5 were blended with the same quantity and quality of additives as in Example 3. The properties of the resulting composition are listed in Table 6.

This experiment and Example 4 shows that a base oil as obtained by the present invention can be successfully used to formulate OW-30 motor gasoline lubricants using the same additives as used to formulate such a grade based on poly-alpha olefins.

TABLE 5

| | PAO-4 | PAO-5 | Base oil of Example 4 |
|---|---|---|---|
| kinematic viscosity at 100° C. (1) | 3.934 | 5.149 | 4.234 |
| kinematic viscosity at 40° C. (2) | 17.53 | 24.31 | 19.35 |
| viscosity index (3) | 121 | 148 | 125 |
| VDCCS @ −35° C. (P) (4) | 13.63 | 23.08 | 21.17 |
| VDCCS @ −30° C. (P) (5) | 10.3 | 16 | 14.1 |
| MRV cP @ −40° C. (6) | 2350 | 4070 | 3786 |

TABLE 5-continued

| | PAO-4 | PAO-5 | Base oil of Example 4 |
|---|---|---|---|
| Pour Point ° C. (7) | Less than −66 | −45 | −45 |
| Noack (wt %) (8) | 13.4 | 6.6 | 10.6 |
| Content (**) cyclo-paraffins (wt %) | n.a. (*) | n.a. | 14 wt % |

(*) Not analysed but presumed to be zero due to the manner in which poly-alpha olefins are prepared.
(**) Content as based on the whole base oil composition
(1) Kinematic viscosity at 100° C. as determined by ASTM D 445,
(2) Kinematic viscosity at 40° C. as determined by ASTM D 445,
(3) Viscosity Index as determined by ASTM D 2270,
(4) VDCCS @ −35° C. (P) stands for dynamic viscosity at −35 degrees Centigrade and is measured according to ASTM D 5293,
(5) VDCCS @ −35° C. (P) stands for dynamic viscosity at −35 degrees Centigrade and is measured according to ASTM D 5293,
(6) MRV cP @ −40° C. stands for mini rotary viscometer test and is measured according to ASTM D 4684,
(7) pour point according to ASTM D 97,
(8) Noack volatility as determined by ASTM D 5800 (Tables 1-6).

TABLE 6

| | 0W-30 specifications | Example 4 | Comparative experiment A |
|---|---|---|---|
| kinematic viscosity at 100° C. (cSt) | 9.3-12.5 | 9.69 | 9.77 |
| VDCCS P @ −35° C. (cP) | 62.0 max | 61.2 | 48.3 |
| MRV cP @ −40° C. (cP) | 60000 max | 17500 | 12900 |
| Yield stress | No | No | No |
| Pour Point (° C.) | — | −60 | −60 |
| Noack (wt %) | — | 11.7 | 11.2 |

We claim:

1. A process to prepare a lubricating base oil and a gas oil comprising (a) hydrocracking/hydroisomerizing a Fischer-Tropsch product, wherein a weight ratio of compounds having at least 60 or more carbon atoms and compounds having at least 30 carbon atoms in the Fischer-Tropsch product is at least 0.4 and wherein at least 30 wt % of compounds in the Fischer-Tropsch product have at least 30 carbon atoms;

(b) separating the product of step (a) into one or more gas oil fractions, a base oil precursor fraction and a higher boiling fraction; and (c) performing a pour point reducing step by catalytic dewaxing to the base oil precursor fraction obtained in step (b).

2. The process of claim 1, wherein at least 50 wt % of compounds in the Fischer-Tropsch product have at least 30 carbon atoms.

3. The process of claim 1, wherein the conversion in step (a) has a conversion between 25 wt % and 70 wt %.

4. The process of claim 1, wherein the base oil precursor fraction has a T10 wt % boiling point of between 200° C. and 450° C. and a T90 wt % boiling point of between 400° C. and 550° C.

5. The process of claim 4, wherein the base oil precursor fraction has a kinematic viscosity at 100° C. of between 3 cSt and 10 cSt.

6. The process of claim 1, wherein two or more base oil grades are prepared from two or more corresponding base oil precursor fractions, which base oil grades have a difference in kinematic viscosity at 100° C. of less than 2 cSt and wherein step (b) is performed such that each base oil precursor fraction is prepared one after the other in a period of time.

7. The process of claim 1, wherein the lubricating base oil comprises the directly obtained product of step (c) from which only a lower boiling fraction is removed.

8. The process of claim 1, further comprising a base oil having a kinematic viscosity at 100° C. of between 3.5 and 4.5, a Noack volatility lower than 14% w and a pour point of between −15° C. and −60° C. by catalytic dewaxing in step (c) a base oil precursor fraction obtained in step (b) having a kinematic viscosity at 100° C. of between 3.2 cSt and 4.4 cSt.

9. The process of claim 1, further comprising a base oil having a kinematic viscosity at 100° C. of between 4.5 and 5.5, a Noack volatility lower than 10 wt % and a pour point of between 15° C. and −60° C. by catalytic dewaxing in step (c) a base oil precursor fraction obtained in step (b) having a kinematic viscosity at 100° C. of between 4.2 cSt and 5.4 cSt.

10. The process of claim 1, wherein the dewaxed fraction obtained in step (c) is separated into two or more base oil grades by vacuum distillation and wherein the required volatility properties of the base oil grades are met by also separating a fraction boiling just below at least one of said grades.

11. The process of claim 10, wherein the fractions boiling just below the base oil grades and having an initial boiling point of above 340° C. are recycled to step (a).

12. The process of claim 10, wherein the vacuum distillation is performed in a vacuum distillation column provided with side strippers.

13. The process of claim 1, wherein part or all of the higher boiling fraction obtained in step (b) is recycled to step (a).

14. The process of claim 1, wherein the catalytic dewaxing in step (c) is performed in the presence of a catalyst comprising a Group VIII metal; an intermediate pore size zeolite having pore diameter between 0.35 nm and 0.8 nm; and, a low acidity refractory binder which binder is essentially free of alumina.

15. The process of claim 1, wherein the initial boiling point of the Fischer-Tropsch product in step (a) is below 200° C.

16. The process of claim 1, wherein the catalyst used in step (a) comprises platinum supported on a silica-alumina carrier.

17. The process of claim 16, wherein the catalytic dewaxing is performed in the presence of a catalyst comprising a Group VIII metal, an intermediate pore size zeolite having pore diameter between 0.35 and 0.8 nm, and a low acidity refractory binder which binder is essentially free of alumina.

18. An automotive engine oil comprising the base oil obtained by the process according to claim 9.

19. An automotive engine oil according to claim 18 according to the 0W-xx specification according to SAE J-300 viscosity classification.

* * * * *